United States Patent [19]

Hartman et al.

[11] Patent Number: 4,530,401

[45] Date of Patent: Jul. 23, 1985

[54] METHOD FOR MAXIMUM IN-SITU VISBREAKING OF HEAVY OIL

[75] Inventors: Kathy J. Hartman, Arlington; Winston R. Shu, Dallas, both of Tex.

[73] Assignee: Mobil Oil Corporation, New York, N.Y.

[21] Appl. No.: 365,844

[22] Filed: Apr. 5, 1982

[51] Int. Cl.[3] ..... E21B 43/24

[52] U.S. Cl. ..... 166/303

[58] Field of Search ..... 166/303, 272

[56] References Cited

U.S. PATENT DOCUMENTS

| | | | |
|---|---|---|---|
| 345,586 | 7/1886 | Hall | 166/303 X |
| 3,129,757 | 4/1964 | Sharp | 166/251 X |
| 3,289,763 | 12/1966 | Belknap | 166/303 |
| 3,292,702 | 12/1966 | Boberg | 166/303 |
| 3,342,260 | 9/1967 | Lumpkin | 166/272 X |
| 3,349,849 | 10/1967 | Closman | 166/303 X |
| 3,405,761 | 10/1968 | Parker | 166/303 X |
| 3,434,544 | 3/1969 | Satter et al. | 166/303 |

FOREIGN PATENT DOCUMENTS

| | | | |
|---|---|---|---|
| 511768 | 8/1939 | United Kingdom | 166/303 |

*Primary Examiner*—George A. Suchfield
*Attorney, Agent, or Firm*—Alexander J. McKillop; Michael G. Gilman; Charles J. Speciale

[57] ABSTRACT

A method for the recovery of viscous oil from a subterranean, viscous oil-containing formation by injecting steam into the formation via at least one well at a sufficient temperature, rate, and in a sufficient amount to effect maximum visbreaking of the oil in place, terminating injection of steam and producing fluids including oil through the same well used for injecting steam. The injection-production cycle may be repeated for a plurality of cycles until the ratio of oil/water in the produced fluids is unfavorable.

3 Claims, 1 Drawing Figure

VISBREAKING DURING
CYCLIC STEAM STIMULATION
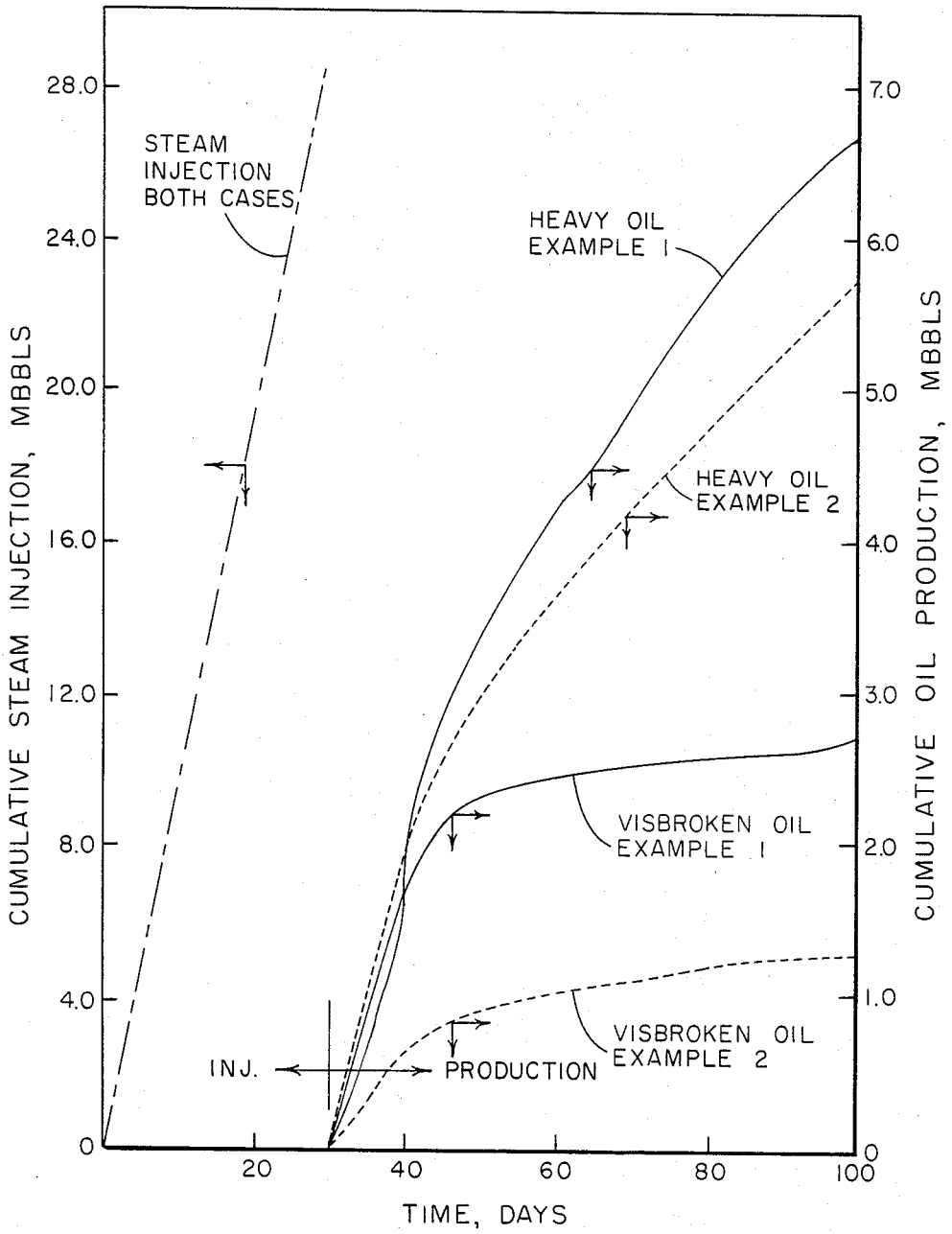

METHOD FOR MAXIMUM IN-SITU VISBREAKING OF HEAVY OIL

FIELD AND BACKGROUND OF THE INVENTION

1. Field of the Invention

This invention pertains to an improved cyclic steam stimulation method for the recovery of viscous oil from subterranean, viscous oil-containing formations.

2. Background of the Invention

Steam has been used in many different methods for the recovery of oil from subterranean, viscous oil-containing formations. The two most basic processes using steam for the recovery of oil includes a "steam drive" process and "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through an injection well, stopping the injection of steam, permitting the formation to soak and then back producing oil through the original injection well.

Heavy or viscous oils go through significant visbreaking upon heating at temperatures normally above 400° F. Such reduction in viscosity significantly enhances recovery during a thermal operation and improves the quality of heavy oils.

In copending application Ser. No. 331,424, now abandoned, filed Dec. 16, 1981 to W. R. Shu et al, there is disclosed a method to induce maximum in-situ visbreaking of heavy oil by injecting high temperature steam into the formation via a well having a selected completion interval and producing oil from the same well used for the injection of steam.

We have found that the cyclic steam stimulation method can be improved to induce maximum visbreaking of the heavy oil in place if the formation contains no underlying water zone, the well completion interval is at least 80% of the vertical thickness of the formation, and the steam is injected as rapidly as possible.

SUMMARY OF THE INVENTION

The invention is a method for recoverying viscous oil from a subterranean, viscous oil-containing formation, preferably with no underlying water zone, comprising penetrating the formation with at least one well in fluid communication with a substantial portion of the formation, preferably at least 80%, injecting steam into the formation via said well at a sufficient temperature, rate, and in a sufficient amount to effect maximum visbreaking of the oil in the formation, terminating injection of steam and recovering fluids including oil from the formation via the same well used for injecting steam. After injection of the steam and prior to production, the well may be shut-in for a predetermined period of time to allow all of the steam to condense in the formation. The temperature in the range of 550° to 650° F. The amount of steam injected is 70 to 700 barrels of cold water equivalent per foot of oil-containing formation thickness. The steam injection rate is 1 to 35 barrels per day per foot of oil-containing formation thickness, depending on formation condition. The injection-production cycles may be repeated for a plurality of cycles until the ratio of oil-water in the produced fluids is unfavorable.

BRIEF DESCRIPTION OF THE DRAWING

The attached drawing is a graph showing the production history and cumulative steam injection vs. time obtained in laboratory evaluation of the process of our invention.

DESCRIPTION OF THE PREFERRED EMBODIMENT

In its broadest aspect this invention relates to a steam push-pull or "huff and puff" stimulation method for the recovery of viscous oil from a subterranean, viscous oil-containing formation wherein steam is injected into the formation at a sufficient temperture, a sufficient injection rate, and sufficient amounts so as to effect maximum visbreaking of the in-place heavy oil.

A relatively thick, subterranean viscous oil-containing formation is penetrated by a single well in fluid communication with a substantial portion of the formation, preferably with at least 80% of the vertical thickness of the formation. Fluid communication is established between the casing of the well and the formation by means of perforations or other openings.

In the first phase of our process, high temperature steam is injected into the formation via the well so as to effect visbreaking of heavy oil in the formation. Visbreaking results in a significant permanent decrease in the viscosity of the oil in place whereby subsequent recovery of the oil is enhanced as well as improving the quality of the recovered oil. The temperature of the injected steam is at least 500° F. and preferably in the range of 550° to 650° F. After a predetermined amount of steam has been injected into the formation, the well is preferably shut in for one to five days or as long as necessary to allow the steam to condense in the reservoir and for the operator to turn the well around for production and then the well is opened and fluids including visbroken oil, water and heavy oil are allowed to flow from the formation into the well from which they are recovered. The cycles of injection of steam and production may be repeated for a plurality of cycles until the ratio of oil/steam in the produced fluid is unfavorable. The extent of visbreaking that occurs may be controlled by the temperature, pressure, the amount and injection rate of the injected steam, as well as with variations in period of time for each injection cycle, number of cycles, and the extent of well completion interval. In addition, it is preferred that the present process be conducted in oil-containing formations having no underlying water layer because such a layer reduces the extent of oil visbreaking.

The amount of steam injected is 70 to 700 barrels of cold water equivalent per foot of oil-containing formation thickness. The steam injection rate is 1 to 35 barrels per day per foot of oil-containing formation thickness, depending upon formation conditions.

EXPERIMENTAL SECTION

Utilizing a computational mode and computer program, we will demonstrate the enhanced oil recovery achieved from the application of our process for a formation with and without an underlying water zone, increased well completion intervals, varying length of injection cycles and number of injection cycles.

All examples to be described more fully hereinafter were performed in a simulated viscous oil-containing formation 150 feet thick with the oil in place having a viscosity of 61,900 cp at 55° F. Saturated steam of 70% quality at a temperature of 650° F. was injected into the formation at an injection rate of about 1000 B/D for 30 days for a total volume of 28,500 bbls.

EXAMPLE 1

In this example, the formation contains no underlying water zone. The production history is shown by the solid lines in the attached drawing. Referring to the drawing, about 2500 bbls of visbroken oil (viscosity 1240 @ 55° F.) was produced after 60 days which increased to about 2700 bbls after 100 days. In addition, 6600 bbls of hot mobile heavy crude and 11,000 bbls of water were produced after 100 days.

EXAMPLE 2

The conditions in this example were the same as in example 1 except that the formation is underlain with 20 feet of water sand (water saturation=88% of pore volume). The production history for this run is shown by the dotted lines in the attached drawing. About 1000 bbls of visbroken oil was produced after 60 days which increased to about 1250 bbls after 100 days. Total production of hot mobile heavy crude was about 5700 bbls. The drastic decrease in production of visbroken oil for Run 2 illustrates that the process should be preferably applied to formations with no significant water underlain.

EXAMPLE 3

In this example the conditions were the same as for example 2. The well completion interval was varied from 50% of the formation thickness to 80%. The 30% increase in completion interval increased total oil production by 25% after 100 days.

EXAMPLE 4

The case in Example 2 was compared to a case in which the total steam injected in 30 days was divided into two 15-day injection periods. The equivalent shorter cycles proved to be slightly detrimental to visbroken oil production.

EXAMPLE 5

The case in Example 2 was also compared to a case in which the total amount of steam injected in 30 days was injected in a 26-day injection period. A 12% increase in visbroken oil production after 100 days was observed.

EXAMPLE 6

The case in Example 2 was repeated exactly for a second cycle. The second cycle showed more visbroken oil production, 1576 bbls, for the same amount of steam injected. This is because the extent of visbreaking increase with time and the introduction of a second cycle allows the oil heated in the first cycle to continue being visbroken.

From the foregoing specification, one skilled in the art can readily ascertain the essential features of the invention and without departing from the spirit and scope thereof can adapt it to various diverse applications. It is out intention and desire that out invention be limited only by those restrictions or limitations as are contained in the claims appended immediately hereinafter below.

What is claimed is:

1. A method of recovering viscous oil from a subterranean, viscous oil-containing formation containing no underlying water zone, comprising:

(a) penetrating said formation with at least one well in fluid communication with at least 80% of the vertical thickness of said formation;

(b) injecting steam into the formation via said well at a temperature within the range of 500° to 650° F. and an injection rate of 1 to 35 barrels of steam (cold water equivalent) per day until 70 to 700 barrels of steam per foot of oil-containing formation thickness has been injected thereby effecting maximum visbreaking of the oil in said formation; and (c) recovering fluids including mobile oil and visbroken oil from said formation via said well.

2. The method of claim 1 wherein steps (b) and (c) are repeated for a plurality of cycles until the ratio of oil/water in the produced fluids is unfavorable.

3. The method of claim 1 including the step of shutting-in said well for a predetermined time period after step (b).

* * * * *